US005377782A

United States Patent [19]

Francis et al.

[11] Patent Number: 5,377,782

[45] Date of Patent: Jan. 3, 1995

[54] SWING ARM SHORT-RISE VEHICLE LIFT

[75] Inventors: Richard T. Francis, Easton; Jerry A. Ohlemeier, St. Joseph, both of Mo.

[73] Assignee: Gray Automotive Products Company, St. Joseph, Mo.

[21] Appl. No.: 42,121

[22] Filed: Apr. 2, 1993

[51] Int. Cl.[6] ..... B66F 7/08

[52] U.S. Cl. ..... 187/219; 254/10 R; 187/217; 187/269

[58] Field of Search ..... 187/8.41, 8.54, 8.64, 187/8.67, 8.71, 8.74, 8.75; 254/134, 10 R, 10 C

[56] References Cited

U.S. PATENT DOCUMENTS 2,949,978 8/1960 Halstead ..... 187/8.74
2,958,395 11/1960 Wallace ..... 187/8.74

FOREIGN PATENT DOCUMENTS 1004355 3/1957 Germany ..... 187/8.75 X
974034 8/1960 Germany ..... 187/8.75 X

OTHER PUBLICATIONS

Herkules; Advertising Literature; K-700, K-703, and K900-P Models.
Rotary; Advertising Literature; PFX and PAL7E Models.
Challenger Lifts: Advertising Literature; MAXX Model.
Gray Automotive Products Company: Equipment Catalog.
Gray Automotive Products Company; Advertising Literature FAST 27 Model.
Sicam: Advertising Literature; PSB-24 Model.

*Primary Examiner*—Robert P. Olszewski
*Assistant Examiner*—Dean A. Reichard
*Attorney, Agent, or Firm*—Hovey, Williams, Timmons & Collins

[57] ABSTRACT

A short-rise lift apparatus is provided which is convertible between a first construction in which a vehicle is lifted directly by a platform that is raised against the body of the vehicle, and a second construction in which a plurality of lift arms are interposed between the platform and the frame of the vehicle so that the vehicle is lifted by the frame when the platform is raised. The plurality of elongated lift arms are retained on the platform and may be translated longitudinally relative to the platform and pivoted about a vertical axis. Each lift arm is removable from the platform so that when the lift arms are removed and the platform is moved toward the raised position, the platform engages the body of the vehicle and lifts it.

12 Claims, 4 Drawing Sheets

FIG. 4.
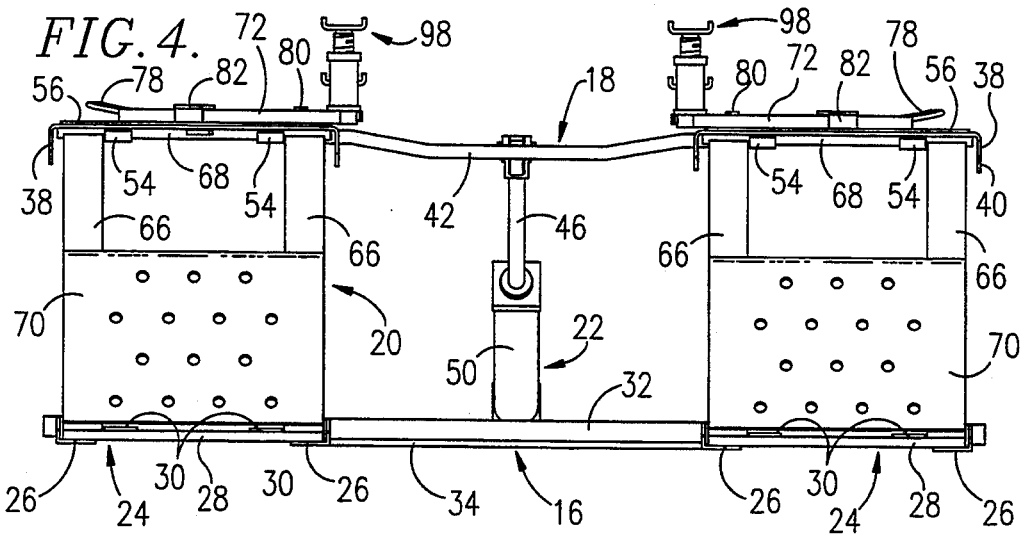
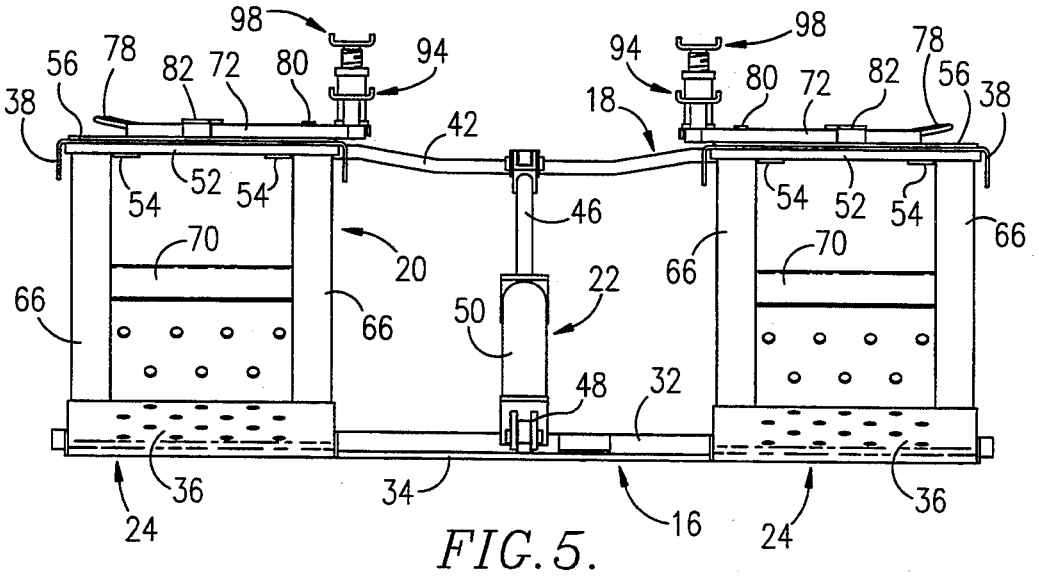
FIG. 5.
FIG. 3.
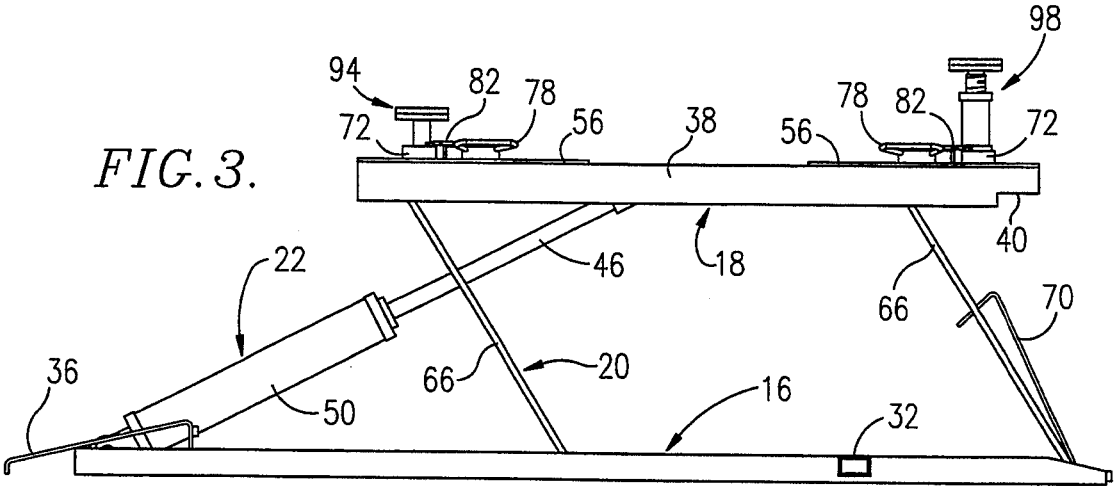

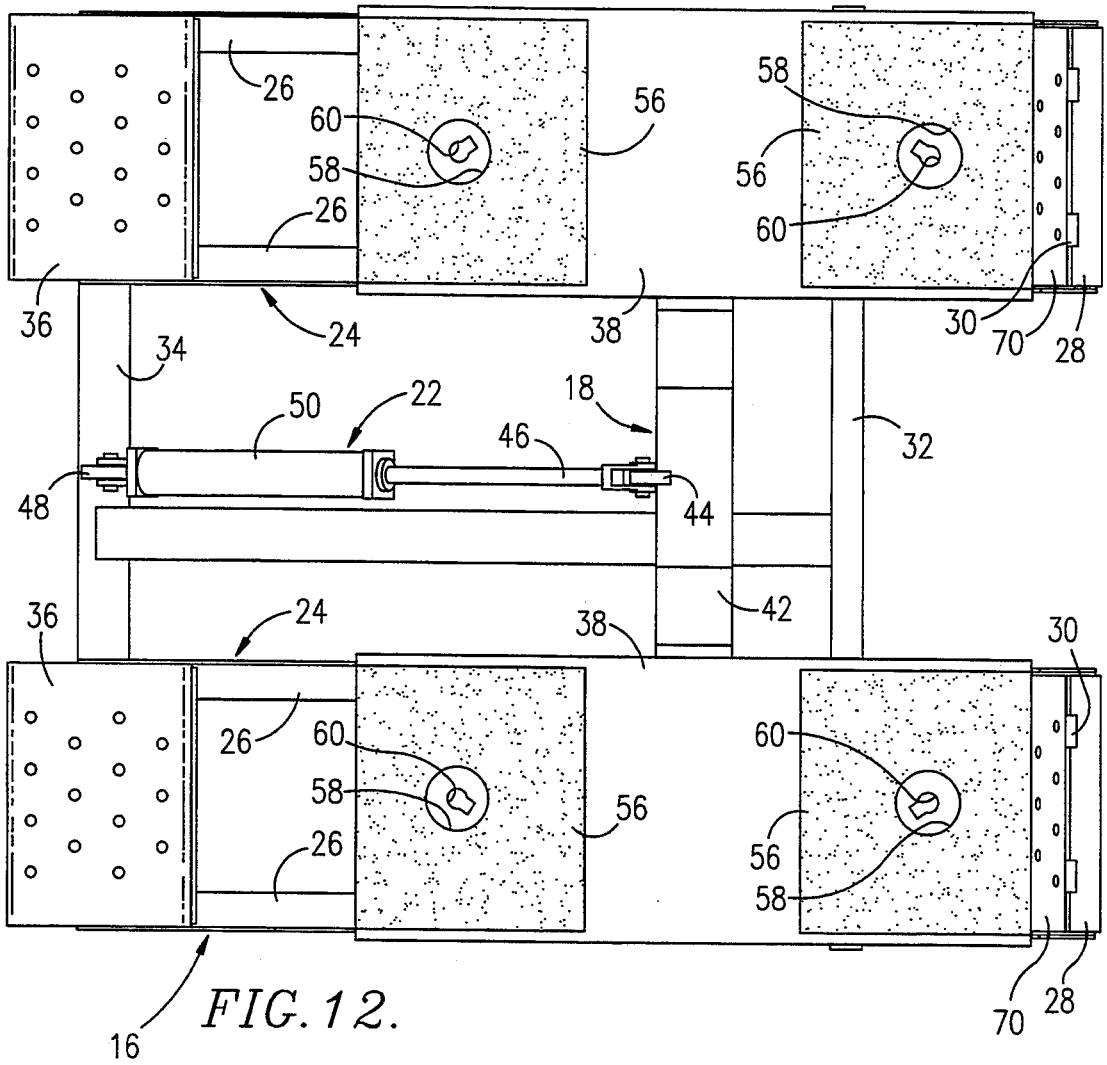
FIG. 12.
FIG. 13.
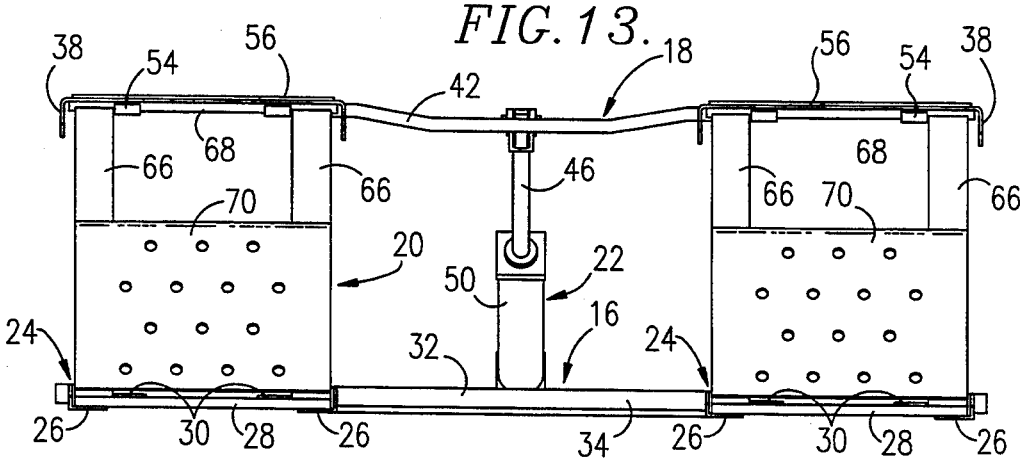

SWING ARM SHORT-RISE VEHICLE LIFT

BACKGROUND OF THE INVENTION

1. Field of the Invention

The present invention relates generally to short-rise vehicle lifts for use in lifting cars and trucks for service to the tires, wheels, brake systems and suspensions thereof, and more particularly, to a short-rise lift apparatus which is convertible between a pad-type configuration and one incorporating lift arms engageable with frame-type vehicles.

2. Discussion of the Prior Art

A conventional short-rise, pad-type vehicle lift includes a low profile frame to which a platform is connected by a plurality of parallel arms pivotably connected between the frame and platform. An example of such a device is presently marketed as the Model QL-60 QUICKLIFT brand lift, offered by Gray Automotive Products Company.

This vehicle lift includes a hydraulic piston-and-cylinder arrangement connected between the frame and platform for moving the platform between a lowered position in which the overall height of the lift apparatus is less than 6 inches, and a raised position in which the platform is lifted to a height of as much as 25. The platform includes an upper surface on which a plurality of pads are secured so that as the platform is raised beneath a vehicle, the pads engage the body of the vehicle and lift it to a desired working height. Thus, the weight of the vehicle is distributed over the large contact area presented by the pads.

Lifts of this conventional type find particular application in use with vehicles of a uni-body construction in which the body is formed without a separate frame. However, approximately 20% of the vehicles presently available in the United States still employ a frame-type construction in which a separate chassis or frame is provided on which an external body is fitted. For example, many pick-ups, light trucks and sport utility vehicles are still constructed of a frame-type design.

Pad-type lifts are of little utility in lifting frame-type vehicles because vehicle frames are commonly situated near the center of the vehicle inside the reach of the platform pads, and components of the vehicle frequently extend below the height of the frame and are of a strength insufficient to support the weight of the vehicle if engaged directly by the pads of the platform. Thus, it is necessary for a garage servicing both types of vehicles to employ a plurality of separate types of lifts.

OBJECTS AND SUMMARY OF THE INVENTION

It is an object of the present invention to provide a short-rise lift apparatus capable of use in lifting both uni-body style vehicles and vehicles incorporating a frame separate from the body thereof, so that the lift may be used with a wider variety of vehicles.

It is another object of the present invention to provide a lift apparatus that permits ready conversion between a pad-type construction and a lift arm construction so that the device may be quickly converted to either configuration depending upon the style of vehicle to be lifted.

In accordance with these and other objects evident from the following description of a preferred embodiment of the invention, a short-rise lift apparatus includes a platform and a means for moving the platform between a lowered position in which the platform is removed from engagement with the vehicle and a raised position in which the platform engages and lifts the vehicle. A plurality of elongated lift arms are attached to and extend upward from the platform so that the vehicle is supported on the lift arms when the lift arms are positioned to underlie the vehicle and the platform is moved to the raised position. Each lift arm is retained on the platform while being permitted to be translated longitudinally relative to the platform and pivoted about a vertical axis. The apparatus also includes a release means for permitting removal of each lift arm from the platform so that when the platform is moved toward the raised position the platform engages and lifts the vehicle.

By this construction, numerous advantages are obtained. For example, by providing lift arms that are removable from the platform, it is possible to use the lift without the lift arms such that the platform is similar to the platform of a conventional pad-type device, and engages the body of a vehicle during lifting. Alternately, when the lift arms are secured to the platform, they are movable to a use position underlying the frame of a vehicle so that when the platform is raised the vehicle is lifted by the frame thereof.

BRIEF DESCRIPTION OF THE DRAWING FIGURES

A preferred embodiment of the present invention is described in detail below with reference to the attached drawing figures, wherein:

FIG. 3 is a side elevational view of the apparatus illustrated in FIG. 2;

FIG. 4 is a rear elevational view of the apparatus illustrated in FIG. 2;

FIG. 5 is a front elevational view of the apparatus illustrated in FIG. 2;

FIG. 12 is a top plan view of the lift apparatus, illustrating four lift arms removed from a platform of the apparatus; and FIG. 13 is a rear elevational view of the apparatus, illustrating the lift arms removed from the platform.

DETAILED DESCRIPTION OF THE PREFERRED EMBODIMENT

Figure 1:
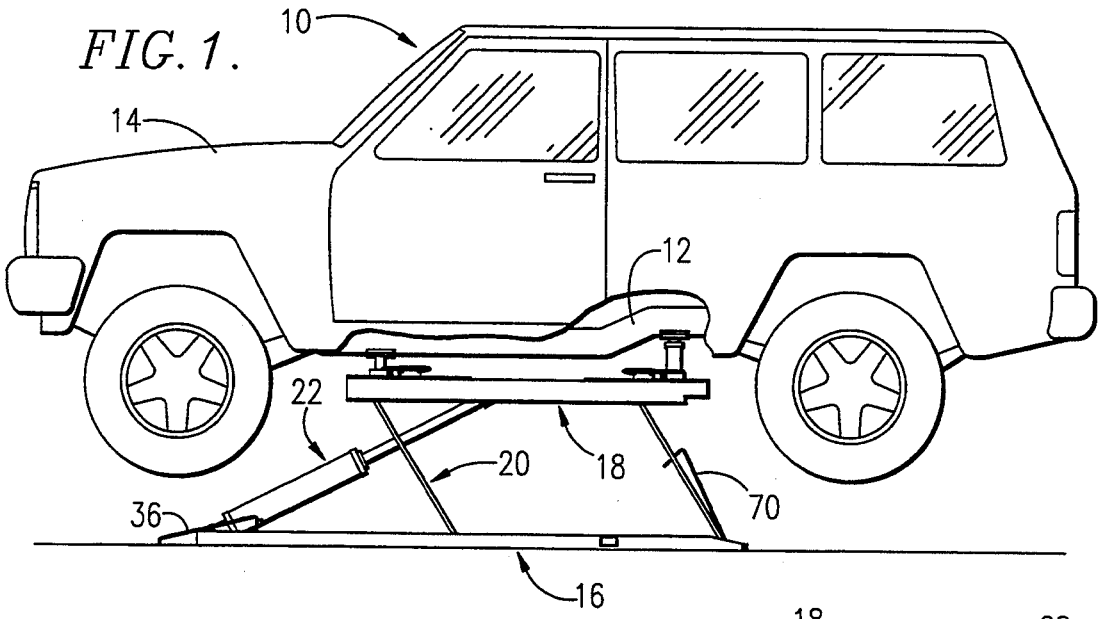
FIG. 1 is a side elevational view of a lift apparatus constructed in accordance with the present invention, illustrating the apparatus in use lifting a vehicle having a separate frame or chassis on which a vehicle body is secured.

A lift apparatus constructed in accordance with the present invention is shown in FIG. 1, lifting a vehicle 10 having a separate frame or chassis 12 on which a vehicle body 14 is secured.

The lift apparatus broadly includes a frame assembly 16, a platform assembly 18, and a plurality of parallel, rigid arm assemblies 20 pivotably connected to both the frame and platform assemblies for permitting the platform assembly to be raised along an arcuate path relative to the frame assembly. A hydraulic piston-and-cylinder assembly 22 is connected between the frame and platform assemblies for lifting and lowering the platform assembly between the raised position shown in the figure and a lowered position in which the platform assembly rests on the frame assembly, presenting a low profile over which the vehicle may be driven.

Figure 2:
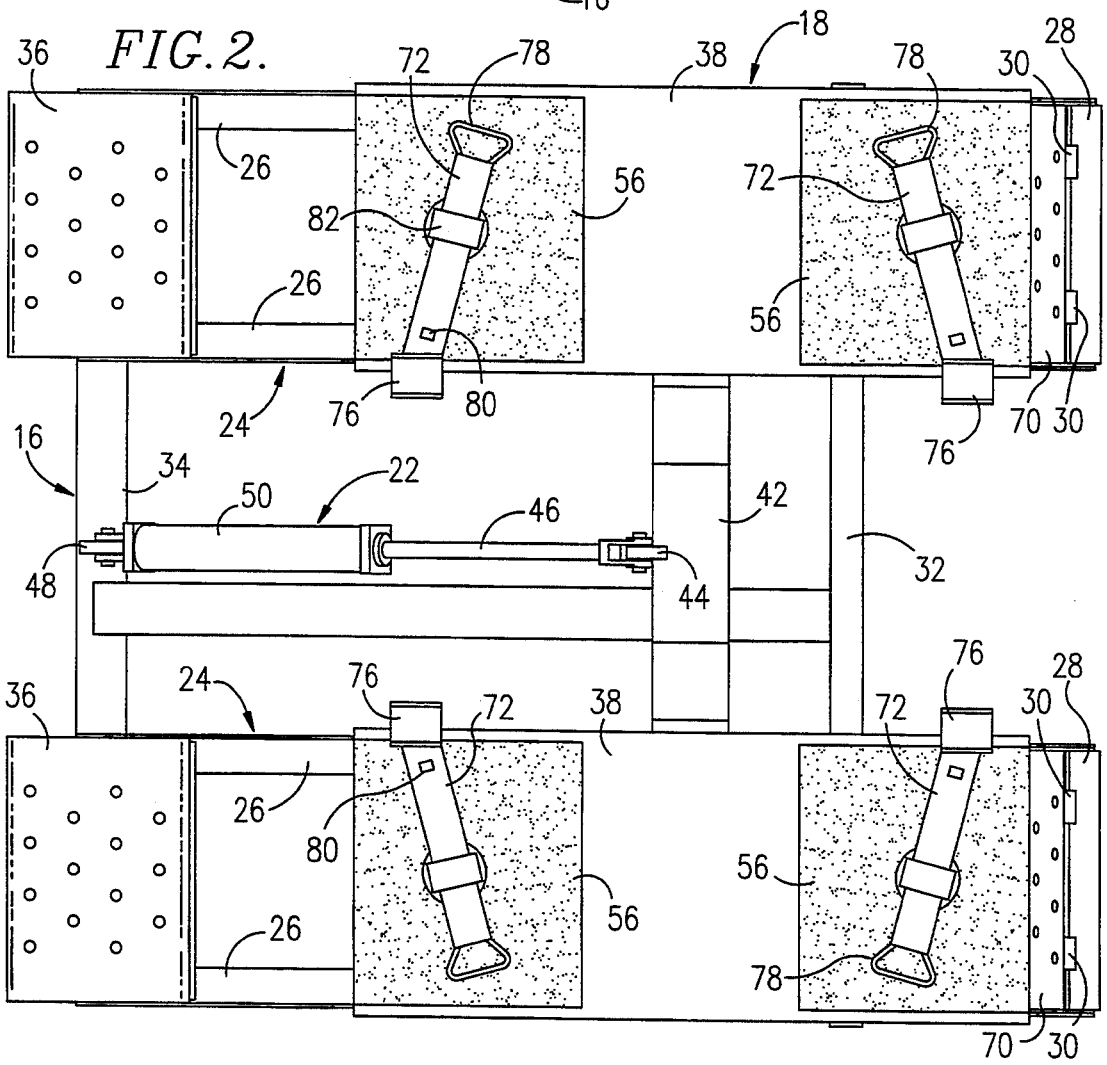
FIG. 2 is a top plan view of the lift apparatus, illustrating four lift arms attached to a platform of the apparatus.

As shown in FIG. 2, the frame assembly includes two laterally spaced channel assemblies 24, each spaced from the other by a distance corresponding to the width of the wheel bases of vehicles to be lifted on the apparatus. Each channel assembly 24 is formed by a pair of elongated, laterally spaced L-shaped bars 26, each including a first leg resting on the floor and a second leg extending upward from the first leg. As shown in FIG. 4, the bars 26 of each assembly are arranged with the first legs directed toward one another so that a U-shaped channel is defined by the bars, and a plurality of crossbars 28 extend between and are welded to the L-shaped bars 26 to secure the L-shaped bars together. In addition, a pair of ears 30 are secured to two of the crossbars of each channel assembly and extend in a direction parallel to the longitudinal direction of the assembly. These ears provide a hinge for the arm assemblies, as described more fully below.

The channel assemblies 24 are secured together by a tubular brace 32 extending across and between the assemblies 24, and secured to each L-shaped bar of the assemblies. In addition, a crossbar 34 extends between the assemblies 24 at the front end thereof, providing a point of attachment for the piston-and-cylinder assembly 22.

As illustrated in FIG. 3, a ramp 36 is secured to one end of each channel assembly 24 and remains with the frame assembly when the platform assembly is moved between the lowered and raised positions. Preferably, each ramp 36 is formed of a flat piece of metal having a non-slip upper surface and down-turned edges which support the ramp at an angle so that a vehicle driven onto the apparatus rides up the ramps onto and over the platform assembly.

The platform assembly is shown in FIG. 2 and includes a pair of laterally spaced, inverted U-shaped channels 38, each of which is of a width slightly greater than the underlying channel assembly 24 such that when the platform assembly is moved to the lowered position, each channel 38 overlaps the underlying channel assembly of the frame, reducing the overall height of the apparatus to a minimum. As shown in FIG. 3, a notch 40 is removed from one end of each of the channels to provide clearance between the platform assembly and the tubular brace 32.

Returning to FIG. 2, the platform is shown to include a cross member 42 that extends between and is connected to the channels 38. This cross member, along with the arm assemblies 20, maintains the lateral spacing of the channels 38, giving structural integrity to the platform assembly. In addition, a boss 44 is provided on the cross member 42 intermediate the channels 38 for receiving a piston rod 46 of the piston-and-cylinder assembly 22. The rod 46 is connected to the boss 44 by a pin which permits relative pivotable movement between the platform and the rod. A similar boss 48 is secured to the crossbar 34 of the frame assembly, and receives a cylinder 50 of the assembly 22. A pin holds the cylinder to the boss while permitting relative pivotable movement therebetween.

Figure 9:
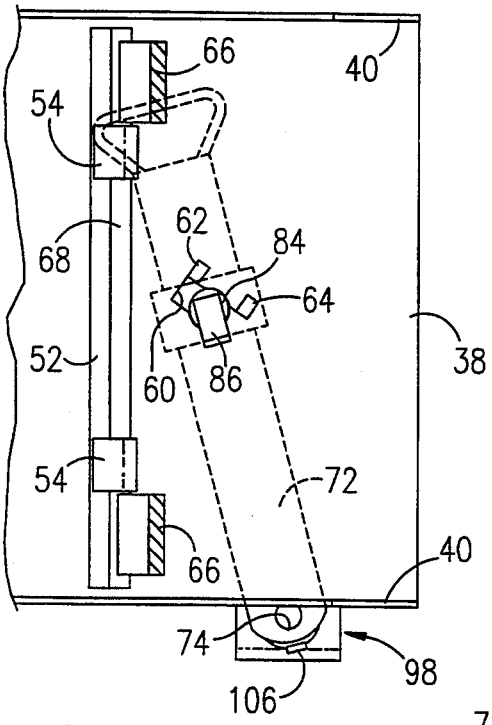
FIG. 9 is a fragmentary bottom plan view of the platform, illustrating the lift arm secured to the platform and situated in a use position.

As shown in FIG. 9, which is a view of the underside of one of the U-shaped platform channels, a bar 52 is secured to the channel at each point of attachment between each channel and the arm assemblies 20, and extends in a direction transverse to the longitudinal axis of the channel. A pair of L-shaped ears 54 are provided on each bar, and define a hinge for the arm assemblies, as described below.

Turning to FIG. 12, each of the channels are shown to include an upper surface on which a pair of longitudinally spaced pads 56 are provided. These pads are preferably riveted to the channels, and define a bearing pad surface which directly contacts and lifts the body of a vehicle when the apparatus is used in the configuration shown in FIGS. 12 and 13. Each pad 56 includes a central hole 58 extending therethrough which exposes a smaller, noncircular hole 60 formed in the channel beneath the pad. As shown in FIG. 9, the underside of each channel is provided with a pair of depending stops 62, 64 adjacent each hole, one 62 of which is positioned laterally outward of the hole 60 and the other 64 of which is displaced from the hole 60 in a direction toward the closest axial end of the channel 38. The function of these holes and stops is described more fully below.

There are four separate arm assemblies 20, two of which are associated with each channel 38 of the platform assembly. Each arm assembly includes a pair of laterally spaced, parallel arms 66 formed of a rigid material, such a flat bar stock steel or the like. These parallel arms are connected together at each end by a cylindrical pivot rod 68, also formed of steel or the like so that a rigid rectangular linkage is formed. One of the pivot rods of each assembly is pivotably secured to the frame assembly 16 while the other pivot rod is pivotably secured to the platform assembly 18. Preferably, each pivot rod 68 is retained within one of the hinges defined either by the ears 30 on the crossbars 28 of the frame assembly or by the ears 54 on the bars 52 secured to the underside of the platform channels 38.

The hinges on each channel assembly of the frame are aligned laterally with the hinges of the other channel assembly, and the hinges on each channel of the platform are aligned laterally with the hinges of the other channel. By providing this construction, the arms of all four arm assemblies 20 are parallel to one another and are movable along parallel arcuate paths as the platform assembly is moved between the raised and lowered positions.

A pair of ramps 70 are secured to the two arm assemblies located adjacent the rear end of the frame opposite the ramps 36. These ramps 70 present an angled, non-skid surface upon which a vehicle may travel as it drives up and over the apparatus. Thus, ramps are provided at both ends of the lift so that a vehicle may be driven onto or off of the lift from either direction.

As mentioned, the cylinder 50 is pivotably connected to the crossbar 34, and the piston rod 46 is connected to the cross member 42 extending between the channels 38 of the platform assembly. Thus, when fluid is delivered to the cylinder and the rod is extended, the platform is raised to an elevated position over the frame, as shown in FIG. 3. Lowering of the platform is achieved by removing fluid from the cylinder such that the rod retracts into the cylinder allowing the platform to rest against the frame.

Although not shown, a source of hydraulic fluid is provided, as well as a pump and a control assembly for controlling the delivery of fluid to and from the cylinder. For example, a fluid reservoir may be provided in combination with a pneumatic piston-and-cylinder assembly so that operation of the pneumatic assembly pumps fluid between the reservoir and the hydraulic cylinder. This construction enables the apparatus to be powered by an external pneumatic source such as is readily available in many service garages.

As thus far described, the lift apparatus is capable of lifting any vehicle having a uni-body construction wherein the body is able to support the entire weight of the vehicle when lifted by the pads 56. However, in order to permit lifting of other vehicles, a swing arm system is provided.

Figure 8:
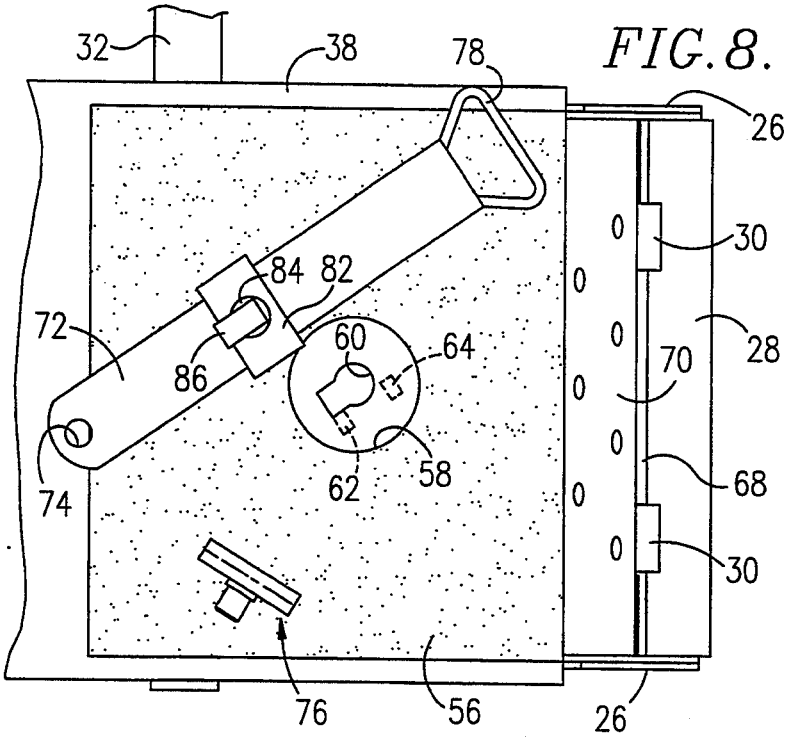
FIG. 8 is a fragmentary top plan view of the platform, illustrating a lift arm removed from and resting upside down on the platform, and a lift pad positionable on the lift arm.

Turning first to FIG. 8, each of the four lift arms 72 associated with the system includes an elongated body formed of steel or the like, and having a rectangular cross-sectional shape and a pair of opposed axial ends. One of the axial ends includes a transverse hole 74 extending through the bar and adapted to receive a lift pad 76. The opposite axial end of the arm is provided with a handle 78 in the form of a looped piece of steel which is welded to the body, and the handle is of a width larger than the width of the bar.

Figure 7:
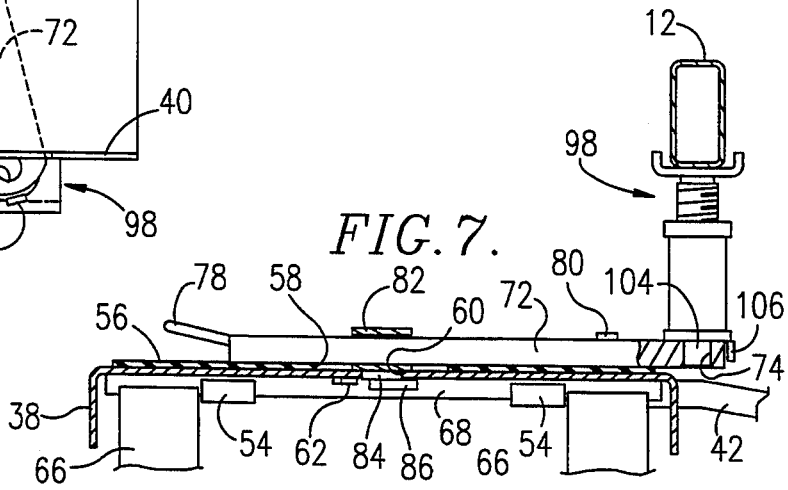
FIG. 7 is a fragmentary end sectional view of the platform, again illustrating one lift arm of the apparatus.

As shown in FIG. 7, an upstanding tab 80 is attached to an upper surface of the body adjacent the first axial end thereof. A collar 82 is received on each lift arm and includes a rectangular opening corresponding to the cross-sectional shape of the body. The collar is retained on the arm by the handle 78 at one end of the body and by the upstanding tab 80 at the opposite end. However, the collar may be translated relative to the bar along the length of the body extending between the handle and the tab.

A depending cylindrical support shaft 84 extends from the bottom surface of the collar, and a key 86 is attached to the bottom of the shaft and extends radially therefrom. Preferably, the key is formed of a small piece of steel bar stock that is welded to the bottom side of the shaft. The profile shape presented by the shaft and key when viewed in the direction of the longitudinal axis of the shaft is circular except for a protruding rectangular area connected to the circle.

This profile shape of the shaft and key is identical to the shape of the holes 60 in the platform channels 38 so that when the lift arm is turned right side up and the shaft and key are aligned with one of the holes 60, it is possible to insert the shaft and key into the hole so that the collar 82 rests against the upper surface of the platform within the hole 58 formed in the pad. When the collar is in alignment with the hole 60 in this manner, the lift arm 72 is oriented in a non-use position, with the handle located inboard of the platform channel and with the lift pad outboard of the channel.

Thus, as long as the shaft and key of the collar are in alignment with the hole of the platform, the lift arm is removed from any position in which the lift pad would underlie the frame of a frame-type vehicle. As shown in FIG. 7, when the shaft and key have been inserted into one of the holes 60, the key 86 clears the thickness of the channel 38 so that the collar and lift arm may be rotated or pivoted within the hole. However, the close clearance between the shaft 84 and the circular portion of the hole 60 prevents the arm from being pulled from the platform so long as the arm is out of alignment with the hole 60.

Turning to FIG. 9, the limit stop 62 prevents the lift arm from being rotated in the clockwise direction, when viewed from beneath the platform, so that the lift arm may only be rotated in the opposite direction toward a use position. The limit stop 64 also extends into the path of travel of the key 86 and limits rotation of the collar 82 in the clockwise direction beyond the range of possible use positions. As the collar is turned within the hole, the arm may be translated relative to the collar in order to properly align the lift pad 76 with the frame of a vehicle to be lifted. A similar operation is carried out for each of the lift arms so that four points of contact are provided between the lift and the vehicle.

Removal of the lift arms is accomplished by simply reversing the steps used to install the lift arms on the platform. Thus, each lift arm may be removed simply by rotating the collar to the non-use position of the arm, and lifting the arm from the hole. During use, the vehicle to be lifted is first driven over the platform assembly, with the lift arms removed. Thereafter, the lift arms are attached to the platform assembly and aligned so that the lift pads 76 underlie the frame of the vehicle, and the platform assembly is lifted to raise the vehicle to a desired working height.

Figure 10:
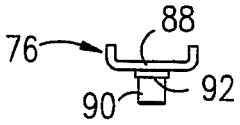
FIG. 10 is a side elevational view of the lift pad.
Figure 11:
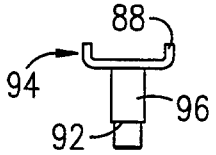
FIG. 11 is a side elevational view of a modified pad.

As shown in FIG. 10, the lift pad 76 includes a U-shaped channel 88 provided with a depending shaft 90 adapted for receipt within the transverse holes 74 of the lift arms. A shoulder 92 on the shaft 90 supports the channel above the arm 72 so that the channel may be rotated or pivoted to a desired orientation. A modified lift pad 94 is shown in FIG. 11, and includes a shaft 96 having an extended shaft above the shoulder 92 so that the channel is supported higher above the lift arm than with the pad 76.

Figure 6:
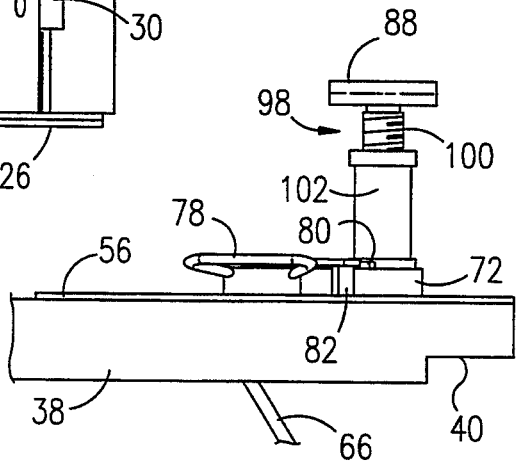
FIG. 6 is a fragmentary side elevational view of the platform, illustrating one lift arm of the apparatus.

Another type of lift pad 98 is illustrated in FIG. 6, and includes a threaded shaft 100 connected to the channel, and an internally threaded housing 102 within which the shaft is received. The housing includes a depending shaft 104, shown in FIG. 7, adapted to fit within the holes of the arms, and the threaded shaft is adjustable within the housing to permit adjustment of the height of the channel above the lift arm. Because the frame of many frame-type vehicles is not straight, but includes different stepped sections, such adjustment in pad height is a desirable feature. A depending lug 106 on the housing prevents the housing from turning within the holes 74 during adjustment.

Although the invention has been described with reference to the attached drawing figures, it is noted that substitutions may be made and equivalents employed herein without departing from the scope of the invention as recited in the claims.

What is claimed is:

1. A short-rise lift apparatus for a vehicle comprising:

a platform;

a means for moving the platform between a lowered position in which the platform is removed from engagement with the vehicle and a raised position in which the platform engages and lifts the vehicle;

a plurality of elongated lift arms attached to and extending upward from the platform so that the vehicle is supported on the lift arms when the lift arms are positioned to underlie the vehicle and the platform is moved to the raised position;

a retaining means slidably engaging each lift arm for retaining a respective lift arm on the platform while permitting each lift arm to be linearly translated longitudinally in opposite directions along a corresponding longitudinal axis thereof relative to the platform and pivoted about a vertical axis; and a release means for permitting removal of each lift arm from the platform so that when the platform is moved toward the raised position the platform engages and lifts the vehicle.

2. A short-rise lift apparatus as recited in claim 1, wherein the lift arms each include first and second opposed axial ends, and a lift pad supported on the first end and adapted to engage the vehicle when the platform is moved to the raised position.

3. A short-rise lift apparatus for a vehicle comprising:

a platform;

a means for moving the platform between a lowered position in which the platform is removed from engagement with the vehicle and a raised position in which the platform engages and lifts the vehicle;

a plurality of elongated lift arms attached to and extending upward from the platform so that the vehicle is supported on the lift arms when the lift arms are positioned to underlie the vehicle and the platform is moved to the raised position;

a retaining means for retaining each lift arm on the platform while permitting the lift arm to be translated longitudinally relative to the platform and pivoted about a vertical axis; and a release means for permitting removal of each lift arm from the platform so that when the platform is moved toward the raised position the platform engages and lifts the vehicle, said retaining means including a collar associated with each lift arm, each collar being retained on the platform and having an opening of a shape corresponding to the cross-sectional shape of the associated lift arm so that the lift arm may be translated relative to the collar.

4. A short-rise lift apparatus as recited in claim 3, wherein the collar is pivotable relative to the platform to allow the lift arm to be pivoted between a range of use positions and a non-use position.

5. A short-rise lift apparatus as recited in claim 4, wherein the release means permits release of the collar and lift arm from the platform when the lift arm is pivoted to the non-use position so that the lift arm and collar may be lifted and removed from the platform.

6. A short-rise lift apparatus as recited in claim 5, further comprising pivot stop means for blocking rotation of the collar relative to the platform from the non-use position to the use position in a first direction and for limiting the range of rotation of the collar in the opposite direction.

7. A short-rise lift apparatus as recited in claim 3, wherein each lift arm includes translational stop means for limiting the range of translational movement of the arm relative to the associated collar and for retaining the arm on the collar.

8. A short-rise lift apparatus as recited in claim 5, wherein each collar includes a depending support shaft and a key extending radially from the shaft, and the platform includes an upper surface provided a plurality of holes, each hole being of a shape corresponding the profile shape presented by the shaft and key of each collar when the collar is positioned over the hole with the lift arm in the non-use position.

9. A short-rise lift apparatus as recited in claim 8, wherein the key of each collar extends beneath the upper surface of the platform when the collar is inserted into one of the holes so that the collar may be rotated within the hole between the non-use and use positions.

10. A short-rise lift apparatus as recited in claim 2, wherein the lift pads are removable from the lift arms.

11. A short-rise lift apparatus as recited in claim 2, wherein the lift pads each include an upper bearing cradle and means for adjusting the height of the cradle relative to the lift arm.

12. A short-rise lift apparatus as recited in claim 7, wherein the translational stop means includes a handle provided on the lift arm for limiting movement of the collar in a first direction while allowing handling of the lift arm.

* * * * *